United States Patent [19]

Williams

[11] 4,258,346

[45] Mar. 24, 1981

[54] MAGNETICALLY ACTUATED DIGITAL SWITCH

[76] Inventor: Roger W. Williams, 7294 Glenview, Fort W1rth, Tex. 76118

[21] Appl. No.: 11,060

[22] Filed: Feb. 9, 1979

[51] Int. Cl.[3] ..... H01H 50/06; H01H 36/00

[52] U.S. Cl. ..... 335/206; 340/543; 361/172

[58] Field of Search ..... 335/206, 207; 340/543; 361/172

[56] References Cited

U.S. PATENT DOCUMENTS

| | | | |
|---|---|---|---|
| 3,750,062 | 7/1973 | Goto | 335/206 |
| 3,813,663 | 5/1974 | Perkins | 361/172 |

*Primary Examiner*—Harold Broome

*Attorney, Agent, or Firm*—Richards, Harris & Medlock

[57] ABSTRACT

A magnetically operated digital switch (10) includes an array of magnetically actuated relays (14–24) mounted adjacent a magnetic shield (26) having an array of holes (28–38) therein corresponding to the location of the relays (14–24). The switch assembly is mounted on a nonmagnetic plate so that the relays can be actuated by a small magnet (58) which is positioned adjacent the holes in the magnetic shield (26). The shield (26) prevents magnetic flux which is applied to one of the relays from being spilled over and inadvertently actuating a nearby relay. An alarm circuit (50) is provided to decode the key number sequence entered into the digital switch (10) for operation of an alarm relay (56) when the proper key number is entered.

5 Claims, 4 Drawing Figures

MAGNETICALLY ACTUATED DIGITAL SWITCH

TECHNICAL FIELD

The present invention pertains to electrical switches and more particularly to a digital switch actuated by a proximity magnet.

BACKGROUND ART

The conventional procedure for activating and disabling an alarm system for fire and burglar protection has been the operation of a key switch located either within the premises to be protected or at the entrance thereof. Although such systems are functional, they do suffer from a number of problems. The open exposure and easy access to a key switch invites tampering to deactivate the system and eliminate the protection which it provides. Further, there is always the necessity that the key be made available to the persons responsible for activating and deactivating the alarm system.

An improvement to this system is the development of a digital, push button operated alarm utilizing a numerical key coding system. However, the installation of the push button system in an appropriate location often presents a problem. In existing buildings, it is often necessary that an expensive and time consuming alteration be made to the structure to install the push button panel in a wall and to run the appropriate electrical lines through the ceiling and wall spaces. In buildings having extensive glass walls, it is difficult or impossible to install a push button panel in a location convenient to the door.

In view of the advantages of push button operated alarm systems and the problems involved in installation, there exists a need for a push button switch actuator and alarm which can be easily installed in convenient locations without the necessity for drilling holes or cutting openings in the building wall. Further, the push button mechanism must be protected from tampering and weather exposure for optimum reliability and longevity.

DISCLOSURE OF THE INVENTION

In accordance with the present invention, there is provided a magnetically actuated digital switch for entering a key code into an alarm circuit for controlling an alarm system.

In accordance with a more specific aspect of the present invention a magnetically actuated digital switch includes a plurality of magnetically operated relays spaced apart and mounted adjacent a nonmagnetic plate together with a shield fabricated of magnetic material and having holes therein aligned with the magnetically operated relays, the shield being located between the relays and the nonmagnetic plate for directing the magnetic flux field produced by a magnet toward a selected one of the relays for operation thereof while isolating the flux field from the remaining relays.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION

Figure 1:
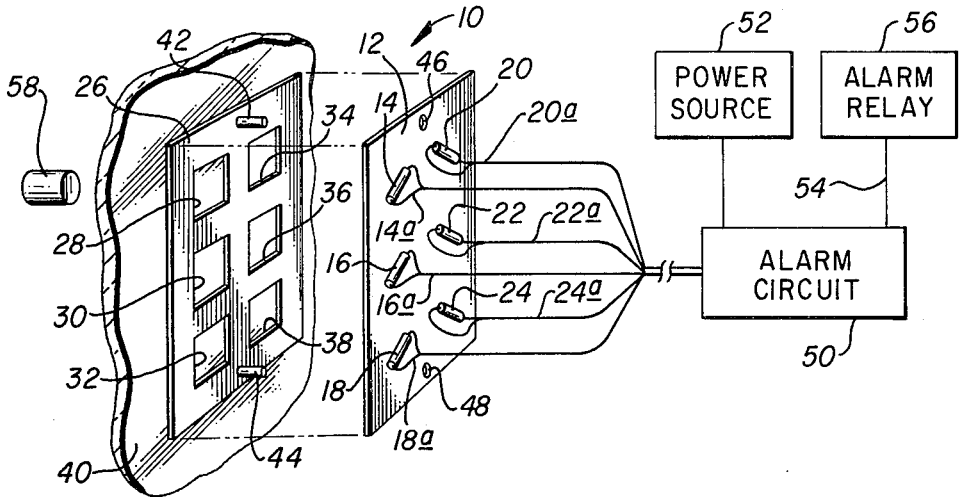
FIG. 1 is a perspective view of the magnetically actuated switch of the present invention as installed with an alarm system.

The magnetically actuated digital switch and alarm system of the present invention are shown in FIG. 1. The magnetically actuated switch shown generally as 10 includes a non-magnetic support board 12 having a plurality of reed relays 14–24 mounted thereon in a rectangular array. The magnetic switch 10 further includes a shield 26 which is plate fabricated of ferromagnetic material having a rectangular array of holes 28–38 therein. The reed relays 14–24 are spaced apart and aligned in the same manner as the holes 28–38 in the shield 26.

The shield 26 is mounted with double-faced adhesive tape 27 to a glass plate 40. Studs 42 and 44 are connected to shield 26. Support board 12 includes holes 46 and 48 which are sized and spaced to receive studs 42 and 44 thereby mounting the support board 12 adjacent to the shield 26 on the glass plate 40.

Each of the reed relays 14–24 are connected by lines **14*a*–24*a* respectively to an alarm circuit 50 which is described in further detail below. A power source 52 comprising either a battery or a power supply is connected to operate the alarm circuit 50. When properly actuated, the alarm circuit 50 generates a signal on line 54 to operate an alarm relay 56** which, for example, activates a burglar alarm system.

The magnetic switch 10 of the present invention is actuated by a magnet 58 which is located on the opposite side of the glass plate 40 from the reed relays 14–24. The magnet 58 is used to activate the reed relays in a predetermined numerical order so as to cause the alarm relay 56 to be actuated. The magnet 58 produces a magnetic flux field which extends through the glass plate 40 to cause actuation of individual ones of the reed relays 14–24. This technique permits the relays to be actuated without any of the mechanism of the switch being located on the exterior of the glass plate 40. The glass plate 40 corresponds to a plate glass window in a store door or display window so that the mechanism is protected from tampering and exposure to weather.

The shield 26 is provided to prevent the magnetic flux generated by the magnet 58 from actuating more than one relay at a time. Shield 26 is constructed of a magnetic material, such as, for example iron or steel, which absorbs the magnetic flux in the area of the plate material but permits the flux to pass through the holes 28–38. For example, when the magnet 58 is placed against the exterior surface of the glass plate 40 in the vicinity of the hole 28 the magnetic flux from the magnet is directed toward the shield 26 but is absorbed by the shield except in the portion over the reed relay 14. The flux passes through the hole 28 to cause the relay 14 to be activated. When the magnet 58 is in the vicinity of the hole 28 the edges of the flux field are absorbed by the shield 26 to prevent any significant amount of flux from passing into the holes 30, 36 and 34. This prevents activation of reed relays 16, 22 and 20 when it is desired only to activate relay 14. In the same manner each individual reed relay may be similarly activated without causing activation of an adjacent relay.

The alarm circuit 50 is programmed with a key number selected in advance by the opertor. This key number provides the code for actuating the alarm relay 56. In order to activate the alarm relay the magnet 58 must be applied to the reed relays 14–24 which are each assigned arbitrary numbers. When the magnet is applied to the reed relays in the order of the key number the alarm circuit recognizes the key number and sends a command on line 54 to activate the alarm relay 56. Although six reed relays are shown in FIG. 1, any number of reed relays may be used for receiving the numerical key as input by the operation of the magnet 58. Further, the numbers may be repeated as often as necessary to have a key number code of any desired length.

Figure 2:
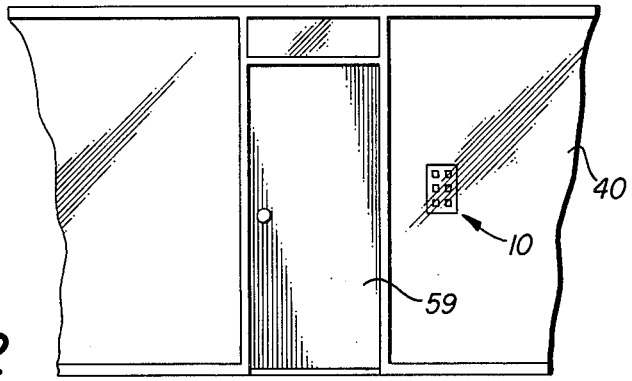
FIG. 2 is an elevation view of a typical installation of the magnetically actuated switch of the present invention.

A typical installation of the magnetically actuated switch and alarm of the present invention is illustrated in FIG. 2. Switch 10 is installed on the interior surface of the glass plate 40 which serves as a display window for a business. The digital switch 10 and the individual switch locations of the relays 14–24 are visible through the glass plate 40. No part of the digital switch is installed on the exterior surface of the glass plate. For convenience the digital switch 10 is located adjacent a door 59 so that the door can be opened immediately after entering the key number sequence into the digital switch.

Figure 3:
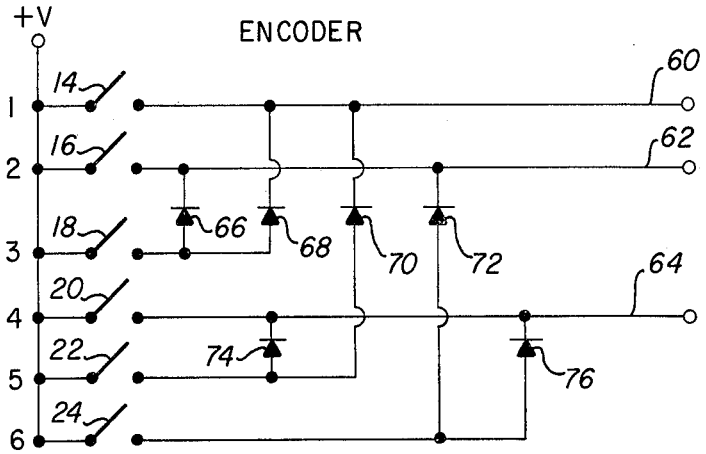
FIG. 3 is a schematic diagram of a switch encoding circuit.
Figure 4:
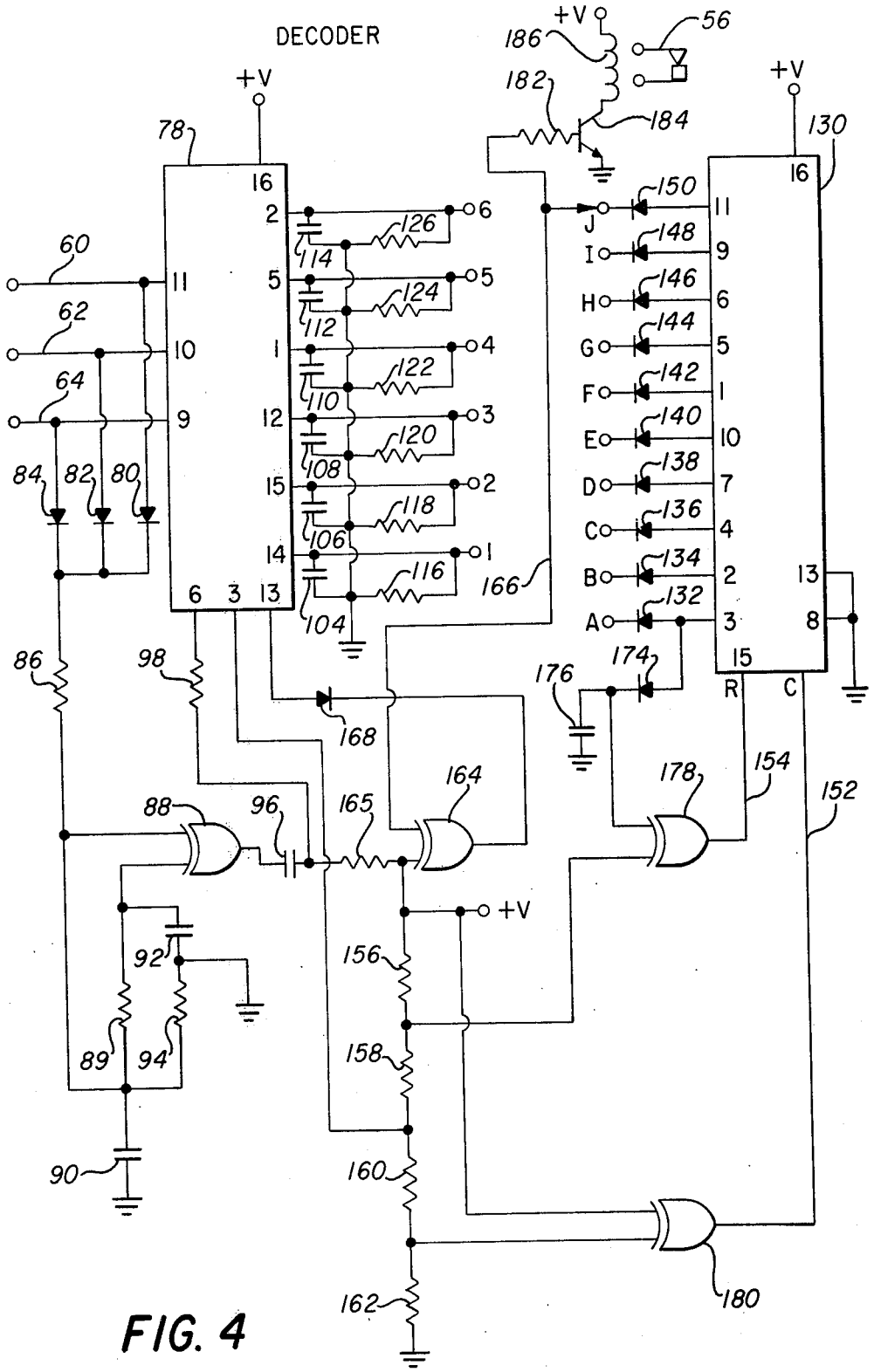
FIG. 4 is a schematic diagram of a decoding alarm circuit in accordance with the present invention.

The alarm circuit 50 is shown as a schematic diagram in FIGS. 3 and 4. FIG. 3 is a schematic diagram for the encoder section of the alarm circuit. Referring to FIG. 3, the reed relays 14–24 are assigned arbitrary numbers 1–6 for entering the key number code. As shown in the schematic diagram the reed relays are normally open. The six reed relays 14–24 are connected in various combinations to lines 60, 62 and 64. A plurality of diodes 66–76 serve to encode relay numbers for operation by the alarm circuit. Each of the relays produces a unique combination of logic levels on the three lines 60, 62 and 64. For example, closure of reed relay 18 raises the level on lines 60 and 62 to that of voltage source V. This is accomplished by forward biasing diodes 66 and 68 to prevent a low impedence path between the voltage source V and lines 60 and 62. Diodes 70 and 72 are reversed biased by this operation to prevent interference with the remaining line 64 which remains at a low level. In a similar fashion each of the reed relays generates a unique combination of logic levels on lines 60, 62 and 64.

Referring now to FIG. 4 there is illustrated a schematic diagram for the decoder section of the alarm circuit 50. The logic signals generated on lines 60, 62 and 64 are input to a "one of eight" integrated circuit 78. Integrated circuit 78 selectively connects pin 3 to one of its pins 1, 2, 5, 12, 14 or 15. The selection is determined by the combination of logic levels input on lines 60, 62 and 64 which are connected respectively to pins 11, 10 and 9. Following the connection of pin 3 to one of the above listed terminals, pin 3 is momentarily connected to pin 13 and then returned to an open condition.

Pin 6 of circuit 78 activates an inhibit function for the integrated circuit and no interconnection is made to pin 3 when the voltage level on pin 6 is high. The inhibit is removed when the voltage level on pin 6 is low The lines 60, 62 and 64 are connected respectively through diodes 80, 82 and 84 through a resistor 86 to a first input of an EXCLUSIVE OR gate 88. The circuit comprising the second input to OR gate 88 includes a series combination of a resistor 89 and capacitor 90. The junction of resistor 89 with capacitor 90 is connected to resistor 86. The remaining terminal or resistor 89 is connected to the second input of OR gate 88 while the second terminal of capacitor 90 is connected to ground.

A capacitor 92 is connected in series with a resistor 94 with the junction of the series combination being grounded. The free terminal of capacitor 92 is connected to the second input of OR gate 88 and the free terminal of resistor 94 is connected to the junction of resistor 89 with capacitor 90. The output of OR gate 88 is connected through a capacitor 96 and a resistor 98 to inhibit pin 6 of circuit 78.

OR circuit 88, together with the associated circuitry, provides a time delay to permit stabilization of the signal levels on lines 60, 62 and 64. A high level is normally applied to pin 6 of circuit 78 to inhibit operation of the interconnection logic which connects one of the six designated pins to pin 3. But, when a high logic level is received on any one of the three lines 60, 62 or 64 the output of the OR gate 88 is temporarily made low following a fixed time delay which in this embodiment is approximately 30 milliseconds. After a momentary dip to a low logic level, the output of the OR circuit 88 returns to the high level. The connection of a terminal to pin 3 of circuit 78 occurs during this momentary dip.

Pins 14, 15, 12, 1, 5 and 2 of circuit 78 each have connected respectively thereto capacitors 104, 106, 108, 110, 112 and 114. Joined respectively in parallel with these capacitors and tied to ground are resisters 116, 118, 120, 122, 124 and 126.

An integrated circuit 130 provides a "divide by ten" function wherein it has a normally high level on pin 3 and normally low levels on pins 2, 4, 7, 10, 1, 5, 6, 9 and 11. These pins are connected through diodes 132–150 to terminals labels A–J, respectively. Whenever a clock pulse is received on the clock pin C on line 152, the logic level on terminal A is changed from high to low and the logic level on terminal B is made high with the remaining terminals of circuit 130 being unchanged. When a second clock pulse is received on line 152, the logic level on terminal B is made low and the logic level on terminal C is made high. In this same manner, the high logic level is stepped through the remaining terminals D–J. The R pin (15) connected to line 154 resets circuit 130 when a high logic level is received. In the reset condition, all of the terminals B–J are low while terminal A is high.

The pins 14, 15, 12, 1, 5 and 2 of circuit 78 are connected to terminals 1–6 respectively for programming the key number into the alarm circuit. The alarm circuit is programmed by interconnecting jumper wires between terminals A–J and 1–6. For example, the code number 5136 is programmed by interconnecting terminal 5 to terminal A, terminal 1 to terminal B, terminal 3 to terminal C and terminal 6 to terminal D. Any of the terminals A–J can be connected a plurality of times to any one of the terminals 1–6.

In decoding the key number, pin 3 of circuit 78 is raised to a high level for each correct number. Pin 3 is connected to the center point in a series of four resistors, 156–162. A first terminal of resistor 156 is connected as a first input to an EXCLUSIVE OR gate 164 and to voltage source V. A resistor 165 is connected between capacitor 96 and resistor 156. The second input to OR gate 164 is provided by a jumper line 166 connected to one of the terminals A–J. The output of OR gate 164 is connected through a diode 168 to a pin 13 of circuit 78.

Pin 3 of circuit 130 is connected to a diode 174 which is in turn connected to a capacitor 176 having the remaining terminal thereof grounded. The junction of diode 174 and capacitor 176 is connected to the first input of an EXCLUSIVE OR gate 178. The output of OR gate 178 is connected through line 154 to the reset pin (R) of integrated circuit 130. The second input to gate 178 is joined to the junction of resistors 156 and 158.

The voltage source V is connected as a first input to an EXCLUSIVE OR gate 180 which has the second input thereof connected to the junction of resistors 160 and 162. The output of OR gate 180 provides the clock input to integrated circuit 130 through line 152.

The jumper line 166 is connected to a base resistor 182 of transistor 184 which operates solenoid 186 to close alarm relay 56. It is the operation of relay 56 which concludes the action of the alarm circuit 50 after a correct entry of the key number by the operator.

As noted above, the alarm circuit of the present invention is programmed with a key number by interconnecting terminals 1 through 6 of circuit 78 with terminals A–J of circuit 130 with selected numbers connected sequentially to the lettered terminals in order. The jumper line 166 is connected to the lettered terminal of circuit 130 immediately following the last lettered terminal connected to circuit 78. When a high logic level is applied to line 166, the transistor 184 is forward biased, thus causing relay 56 to be activated.

In the initial state, terminal A of circuit 130 is in the high level with the remaining lettered terminals in the low level. When a first correct key number of a key sequence is entered, the logic circuit 78 interconnects one of the terminals 1–6 to pin 3. The first key number is the number of the terminal which is connected to terminal A of circuit 130. This operation applies a high logic level to pin 3, which in turn applies a high level to the second input of OR gate 180. The output of OR circuit 180 is normally high while the integrated circuit 130 is clocked by a positive-going transition. Thus, when a high logic level signal is received at the second input to OR gate 180, the output temporarily goes low and then immediately returns high with the transition from low to high causing the integrated circuit 130 to step the high level from one lettered terminal to the next sequential terminal. The process of stepping the high output level of circuit 130 continues as long as the correct sequence of numbers are activated at switch 10 by magnet 58. When the last number is activated, a high logic level signal is applied to jumper line 166 which in turn activates transistor 184 and relay 56.

Integrated circuit 130 is reset when any one of three conditions occur. When a proper key number sequence has been completed, the circuit will be reset. When a wrong digit is entered into the encoder circuit, the integrated circuit 130 will be reset, and when a long term time delay greater than a predetermined length occurs after the activation of the first last relay, the integrated circuit 130 will also be reset. Each of these functions is necessary for proper operation of the alarm circuit.

When the key number sequence has been correctly entered, the logic level on line 166 will be high and will cause the output of OR gate 164 to transition from its normally high level to a low level and thereby provide a low level signal that allows diode 168 to be forward biased. Pin 13 is then connected to pin 3 momentarily, as described above, and a low level input to OR gate 178 is provided through resistor 158. This causes OR gate 178 to produce a high level output on line 154 which resets circuit 130.

When an incorrect digit is applied in the key sequence, a low level signal on a lettered terminal is connected to pin 3 of circuit 78. This low level is transmitted through resistor 158 to the input of OR gate 178. This causes OR gate 178 to produce a high level output which resets circuit 130.

The turn off after a long time delay, which in this embodiment is set to be approximately one minute, is accomplished by operation of diode 174 and capacitor 176. When terminal A of circuit 130 is high, which is its normal condition, capacitor 176 is charged to a positive voltage. But, as soon as the terminal A is transitioned to a low level, diode 176 is reversed biased and capacitor 176 begins to discharge through the first input terminal of OR gate 178. Capacitor 176 discharges until the signal level applied to the first input of OR gate 178 is sufficiently low to cause the output to invert thereby going to a high level and resetting circuit 130.

In the circuit shown in FIGURE 4 illustrating an exemplary embodiment of the present invention, the integrated circuit 78 is a Fairchild Model 4051, circuit 130 is a Motorola Model MC-14017 and the EXCLUSIVE OR circuits 88, 164, 178 and 180 are included in a single package comprising a Motorola Model MC-14070B.

In summary, the present invention provides a magnetically actuated digital switch which is activated by a lightweight magnet and can be installed on the interior surface of a wall or window where it is not exposed to weather or tampering. There is further provided an alarm circuit for receiving a preselected key number and activating an alarm relay in response to correct entry of the key number.

Although one embodiment of the invention has been illustrated in the accompanying drawings and described in the foregoing detailed description, it will be understood that the invention is not limited to the embodiment disclosed, but is capable of numerous rearrangements, modifications and substitutions without departing from the scope of the invention.

I claim:

1. A magnetically actuable digital code switch comprising in combination, a plate of magnetic material having an operating face with multiple switch locations thereon which are defined in said plate of magnetic material by a two dimensional array of uniform holes therethrough, one of which defines each of said switch locations, means to secure said operating face of said plate to a fixed glass panel with the switch locations visible through said panel, and a magnetic reed relay switch at each said switch locations on the side of said plate opposite said operating face and magnetically actuable through said glass panel and through the holes in said plate.

2. A magnetically actuated digital switch operable through a nonmagnetic panel in response to selected positioning of a magnet, comprising in combination, (a) a plurality of magnetically operated relays spaced apart a distance greater than the dimension of said magnet and mounted on one side of said panel, and (b) a shield comprising a plate of magnetic material and having holes therein, each aligned with one of said relays, said shield between said panel and said relays for directing the magnetic flux field produced by said magnet when placed on the side of said nonmagnetic plate opposite said relays in juxtaposed relation to one of said holes associated with a selected one of said relays for operation of said selected one while shunting said magnetic flux field from the remaining ones of said relays.

3. A magnetically actuated digital switch as recited in claim 2 wherein said magnetically operated relays are reed relays.

4. A magnetically actuated digital switch as recited in claim 2 wherein said shield is a magnetic plate having a rectangular array of holes therein.

5. A magnet actuated digital switch operable through a nonmagnetic panel in a response to selected positioning of said magnet, comprising in combination, (a) an array of magnetically operated reed relays supported in spaced apart positions, (b) a magnetic shield comprising a ferromagnetic plate having a plurality of holes therein one of which corresponds to the position of each of said relays, and (c) means for mounting said shield between said panel and said relays for directing the magnetic flux from said magnet toward the one of said relays in juxtaposition with said magnet for operation thereof when said magnet is in said position on the side of said panel opposite said relays while isolating said magnetic flux field from the remaining ones of said relays.

* * * * *